US010988986B2

(12) United States Patent
In

(10) Patent No.: US 10,988,986 B2
(45) Date of Patent: Apr. 27, 2021

(54) DIRECTIONAL DRILLING APPARATUS USING WATER HAMMER UNIT

(71) Applicant: Suk Shin In, Gwangju (KR)

(72) Inventor: Suk Shin In, Gwangju (KR)

( * ) Notice: Subject to any disclaimer, the term of this patent is extended or adjusted under 35 U.S.C. 154(b) by 0 days.

(21) Appl. No.: 16/610,083

(22) PCT Filed: May 4, 2018

(86) PCT No.: PCT/KR2018/005214
§ 371 (c)(1),
(2) Date: Nov. 1, 2019

(87) PCT Pub. No.: WO2018/203721
PCT Pub. Date: Nov. 8, 2018

(65) Prior Publication Data

US 2020/0080378 A1 Mar. 12, 2020

(30) Foreign Application Priority Data

May 4, 2017 (KR) ..... 10-2017-0056944

(51) Int. Cl.
*E21B 4/14* (2006.01)
*E21B 6/02* (2006.01)
(Continued)

(52) U.S. Cl.
CPC ..... *E21B 6/02* (2013.01); *E21B 4/02* (2013.01); *E21B 7/062* (2013.01)

(58) Field of Classification Search
CPC combination set(s) only.
See application file for complete search history.

(56) References Cited

U.S. PATENT DOCUMENTS 2,620,162 A * 12/1952 Pennington ..... E21B 4/14 173/73
2010/0018774 A1 1/2010 Furuki
2018/0274299 A1* 9/2018 Strange ..... E21B 21/00

FOREIGN PATENT DOCUMENTS

KR 10-2008-0094510 A 10/2008
KR 20-2008-0005915 U 12/2008
(Continued)

OTHER PUBLICATIONS

International Search Report dated Aug. 2, 2018 in related International Patent Application No. PCT/KR2018/005214.
(Continued)

*Primary Examiner* — Cathleen R Hutchins
*Assistant Examiner* — Ronald R Runyan
(74) *Attorney, Agent, or Firm* — Eric L. Lane; Green Patent Law

(57) ABSTRACT

A directional drilling apparatus using a water hammer unit according to the present invention includes a hammer body in which a bit unit configured to perform boring work is installed to be movable upward and downward at an end portion of the hammer body, a piston slidably installed on the hammer body and including an operating fluid discharge part formed in a longitudinal direction, a drive unit installed between the hammer body and the piston to support an upper portion of the piston and configured to move the piston upward and downward using water supplied through a rod connected to the hammer body, a hammer unit including a rotary shaft coupled to a bit by a first coupling part so as to transmit a rotational force in a state in which the hammer unit passes through the piston installed on the hammer body and is moved upward or downward by the bit, and a mud motor unit coupled to the hammer body and configured to rotate the rotary shaft.

4 Claims, 7 Drawing Sheets

(51) Int. Cl.
*E21B 4/02* (2006.01)
*E21B 7/06* (2006.01)

(56) References Cited

FOREIGN PATENT DOCUMENTS

| | | | | |
|---|---|---|---|---|
| KR | 10-2013-0032179 | A | 4/2013 | |
| KR | 10-1661426 | B1 | 9/2016 | |
| WO | WO-2005090737 | A1 * | 9/2005 | ..... E21B 4/14 |

OTHER PUBLICATIONS

Written Opinion in related International Patent Application No. PCT/KR2018/005214.

* cited by examiner

DIRECTIONAL DRILLING APPARATUS USING WATER HAMMER UNIT

TECHNICAL FIELD

The present invention relates to a directional drilling apparatus using a water hammer unit, and more specifically, to a directional drilling apparatus using a water hammer unit capable of rotating a bit of a water hammer unit and performing drilling work from a kick off point (KOP) to a marked point in a predetermined orbital direction that is different from a vertical direction.

BACKGROUND ART

Generally, "drilling" means to drill a relatively small diameter hole in the earth's crust so as to understand a structure or characteristics of a stratum and is performed to acquire various knowledge or to obtain petroleum, natural gas, a hot spring, groundwater, or the like. The drilling depth and the diameter of a borehole vary according to the purpose of use.

According to drilling methods, drilling works are classified into a point-the-bit method in which a drilling direction is changed by changing a direction of a drill bit, a push-the-bit method in which a drilling direction is changed by pushing a housing of a drill part from a wall surface, a whipstock method in which a drilling direction is changed by inserting an auxiliary unit having an inclination in a specific direction, and a jetting method in which a drilling direction is changed by shooting muddy water only in a specific direction to weaken the ground. Such a method of changing a drilling direction is performed by applying a driving force in a lateral direction to provide directivity when an excavation is performed, by changing only a direction of a drill shaft to change the direction, or by adjusting a discharge direction of muddy water. Such a method facilitates precise control of a drilling direction.

Particularly, cable laying and ground survey of the construction industry and the mining sector and drilling investigation used for designing and constructing tunnels and various structures are performed by boring in a vertical or horizontal direction or at a preset and predetermined angle, and thus a drilling direction, a drilling angle, and a correct orientation need to be measured.

In a case in which a metal material having uniform isotropy is drilled during a drilling process, an error is not large, but in a case in which a rock including various materials and having anisotropy is drilled, an error and a deviation of a drilling direction are relatively large, and in a case in which a rock has cracks and joint fractures, an error and a deviation of a drilling direction are more serious.

In addition, when drilling is performed using the above-described conventional drilling methods, there is a problem in that a drilling speed for boring is relatively low.

In Japanese Patent Application Laid-Open No. 05-25998 (Feb. 2, 1993), a direction control method and a direction control apparatus for an excavator are disclosed. The disclosed method and apparatus use a shield body including a head and a tail flexibly connected to a rear portion thereof and control a drilling direction of an excavator using a light beam oriented along a reference line such as a projected line of a terminal to be built.

However, such a conventional direction control method for an excavator may perform direction control using a light beam oriented along a reference line, but, in a case in which the ground is weak and collapsed, excavation work may not be performed smoothly.

Meanwhile, in an excavation apparatus for drilling the ground, one rod among rods connected to each other is installed on a head of a boring apparatus and a hammer apparatus is installed on an end portion of the rod for oil drilling, gas drilling, tunnel boring, construction for underground cabling, underground heat source development, groundwater development, and the like.

The hammer apparatus includes an air hammer using an air pressure according to an operating fluid, a water hammer using high pressure water, or the like. The air hammer uses an air pressure to operate a piston so as to provide hitting power for boring the ground, and drilling a relatively deep hole is difficult. In addition, in the case of the water hammer, since water serving as an incompressible fluid is used as an operating fluid, there are advantages in that hitting power may be high, and soil and rock fragments generated during a boring process may be simultaneously discharged when the provided fluid is discharged. However, when drilling work is performed at a certain inclination, there is a problem in that direction control is not easy.

In Korean Patent Registration No. 876450 and Korean Patent Registration No. 1300243, hammers driven using water are disclosed.

DISCLOSURE

Technical Problem

The present invention is directed to providing a directional drilling apparatus using a water hammer unit capable of rotating a bit which provides hitting power and controlling a drilling direction.

The present invention is also directed to providing a directional drilling apparatus using a water hammer unit capable of preventing excavating power of a bit from being reduced by a piston due to an increase in water pressure inside a bored hole when a depth of the bored hole increases in the ground.

Technical Solution

One aspect of the present invention provides a directional drilling apparatus using a water hammer unit including a hammer body in which a bit unit configured to perform boring work is installed to be movable upward and downward at an end portion of the hammer body, a piston slidably installed on the hammer body and including an operating fluid discharge part formed in a longitudinal direction, a drive unit installed between the hammer body and the piston to support an upper portion of the piston and configured to move the piston upward and downward using water supplied through a rod connected to the hammer body, a hammer unit including a rotary shaft coupled to a bit by a first coupling part so as to transmit a rotational force in a state in which the hammer unit passes through the piston installed on the hammer body and is moved upward or downward by the bit, an outer pipe body coupled to the hammer body by a drilling direction angle adjusting unit, an inner pipe body installed inside the outer pipe body to form a first operating fluid supply path through which an operating fluid is supplied to an inner circumferential surface of the outer pipe body and the hammer unit and including a second operating fluid supply path, a mud motor installed at a lower end side of the inner pipe body and including a driving shaft connected to the rotary shaft so as to rotate the rotary shaft, and a mud motor unit including a pressure distribution unit installed on the outer pipe body and an end portion of the other side of the inner pipe body so as to distribute pressure to the first operating fluid supply path and the second operating fluid supply path.

The directional drilling apparatus using a water hammer unit may further including an operating fluid evacuating portion which is installed between the hammer body, which is disposed between the bit unit and the drive unit, and the piston to guide the piston, forms an evacuating space to which the water between the piston and the bit is evacuated when the piston hits the bit, separates bubbles from the water introduced into the evacuating space, and stores the water at an upper side of the evacuating space.

The operating fluid evacuating portion may include a sub-housing in which both end portions of the sub-housing are fixed to an inner circumferential surface of an interior of the hammer body to support a lower portion of the piston and an upper portion of the bit, an evacuating space to which the water serving as an operating fluid between the piston and the bit is evacuated when the piston hits the bit is formed between an inner circumferential surface of the hammer body and the sub-housing, and an operating fluid evacuating hole through which the water between the piston and the bit is introduced or discharged, and an air-water separating part formed between the sub-housing adjacent to the piston and a hitting part of the bit and the hammer body and configured to separate the bubbles from the water evacuated when the piston hits the bit and to store the water at an upper portion of the evacuating space.

The air-water separating part may include a defining member which is installed between an outer circumferential surface of the piston guide part adjacent to the bit guide part and the inner circumferential surface of the hammer body and in which a plurality of gas passing holes are formed.

The first coupling part which connects the bit and the rotary shaft may be formed by forming a hollow portion in the bit in the longitudinal direction and forming a female spline and a male spline an inner circumferential surface of the hollow portion and an inner circumferential surface of an end portion of the rotary shaft, respectively, to be coupled to each other.

The pressure distribution unit may include a socket installed at an end portion of the exterior to be coupled to the rod, an orifice main body member which has a hollow portion coupled to an end portion of the inner pipe body, having an end portion coupled to an inner circumferential surface of the socket, and communicating with the second operating fluid supply path and in which a plurality of air passing holes communicating with the hollow portion and the first operating fluid supply path are formed, and an orifice member inserted into the hollow portion of the orifice main body member to control a flow rate of the operating fluid passing through the air passing holes and the hollow portion so as to distribute pressure.

Advantageous Effects

A directional drilling apparatus using a water hammer unit according to the present invention can control directivity according to a design of a borehole to be bored and perform directional drilling work as well.

In addition, in the drilling apparatus using a water hammer unit, since an operating fluid evacuating portion is formed in a hammer body, when a piston moved upward or downward by a drive unit hits a bit, water serving as an operating fluid between the bit and an end portion of the piston can be introduced into or discharged from an evacuating space. In addition, the drilling apparatus using a water hammer unit can separate bubbles from the water introduced into the evacuating space and store air in an upper side of the evacuating space. Since reduction of hitting power of the bit and ascending power of the piston due to interference of the water between the piston and the bit when the piston moves upward or downward can be prevented by the operating fluid evacuating portion, and the bit can be simultaneously hit and rotated, flexibility can be improved.

Particularly, the drilling apparatus according to the present invention can perform directional drilling work and straight drilling work as well.

MODES OF THE INVENTION

Figure 1:
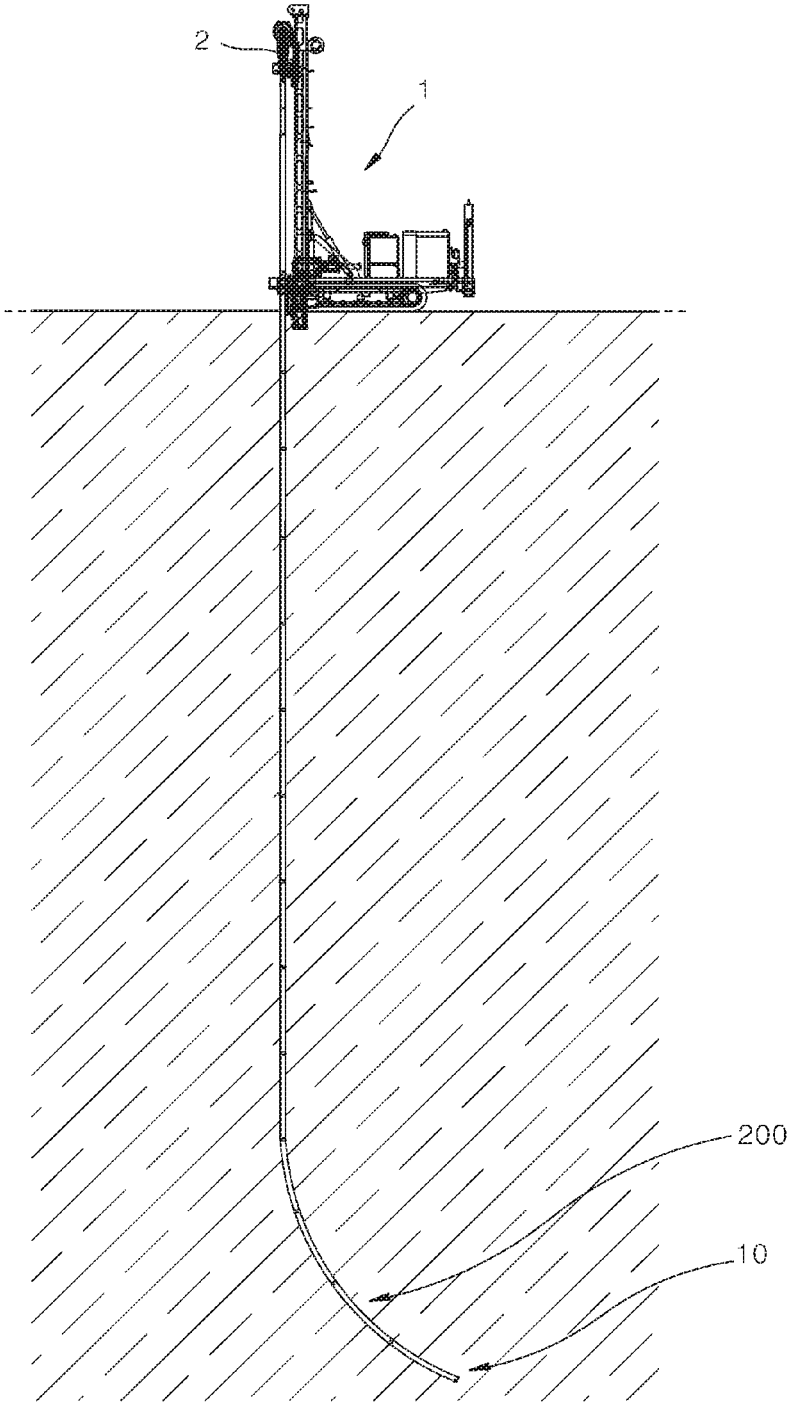
FIG. 1 is a schematic side cross-sectional view illustrating a state in which a directional drilling apparatus using a water hammer unit according to the present invention is installed in a boring apparatus and drilling is performed.

A directional drilling apparatus using a water hammer unit according to the present invention and a directional indentation method are for performing directional drilling work for geothermal power generation, oil and natural gas, hot springs, groundwater, core samples for knowledge in the earth's crust, cable laying, and the like, and one embodiment thereof is illustrated in FIGS. 1 to 7.

Referring to the drawings, the directional drilling apparatus using a water hammer unit according to the present invention is installed in a boring apparatus 1 to drill the ground and includes a water hammer unit 10 using a bit to drill the ground and a mud motor unit 200 coupled to the water hammer unit 10 by a drilling angle adjusting unit 130 and configured to rotate the bit, that is, a bit 32 hit by a piston, of the water hammer unit 10. An accumulating unit 300 for buffering may be further provided between the mud motor unit 200 and the drilling angle adjusting unit 130.

The directional drilling apparatus 10 using a water hammer unit formed as described above according to the present invention will be described in more detail below.

The water hammer unit 10 and the water hammer unit 10 of the directional drilling apparatus using the same are moved downward by a head 2 of a boring apparatus 1 and are operated by an operating fluid supplied through rods 3 connected to each other and the mud motor unit 200 to bore the ground.

The water hammer unit 10 includes a hammer body 20 which has a coupling part 21 coupled to the drilling angle adjusting unit 130 at an upper side thereof and in which a bit unit 30 configured to perform boring work is installed at a lower side thereof. In addition, the water hammer unit 10 includes a piston 40 slidably installed in the hammer body 20 and including an operating fluid discharge part 41 in a longitudinal direction.

In addition, the water hammer unit 10 includes a rotary shaft 48 coupled to the bit 32 by a first coupling part 47 to transmit a rotational force in a state in which the rotary shaft 48 passes through the piston 40 installed in the hammer body 20 and moves the bit 32 upward or downward.

One side of the rotary shaft 48 is coupled to the bit by the first coupling part 47 so as to transmit the rotational force in the state in which the rotary shaft 48 passes through the piston installed in the hammer body and moves the bit upward or downward, and a second coupling part 49 coupled to a driving shaft of the mud motor unit 200 which will be described below is formed on an end portion of the other side of the rotary shaft 48.

Figure 2:
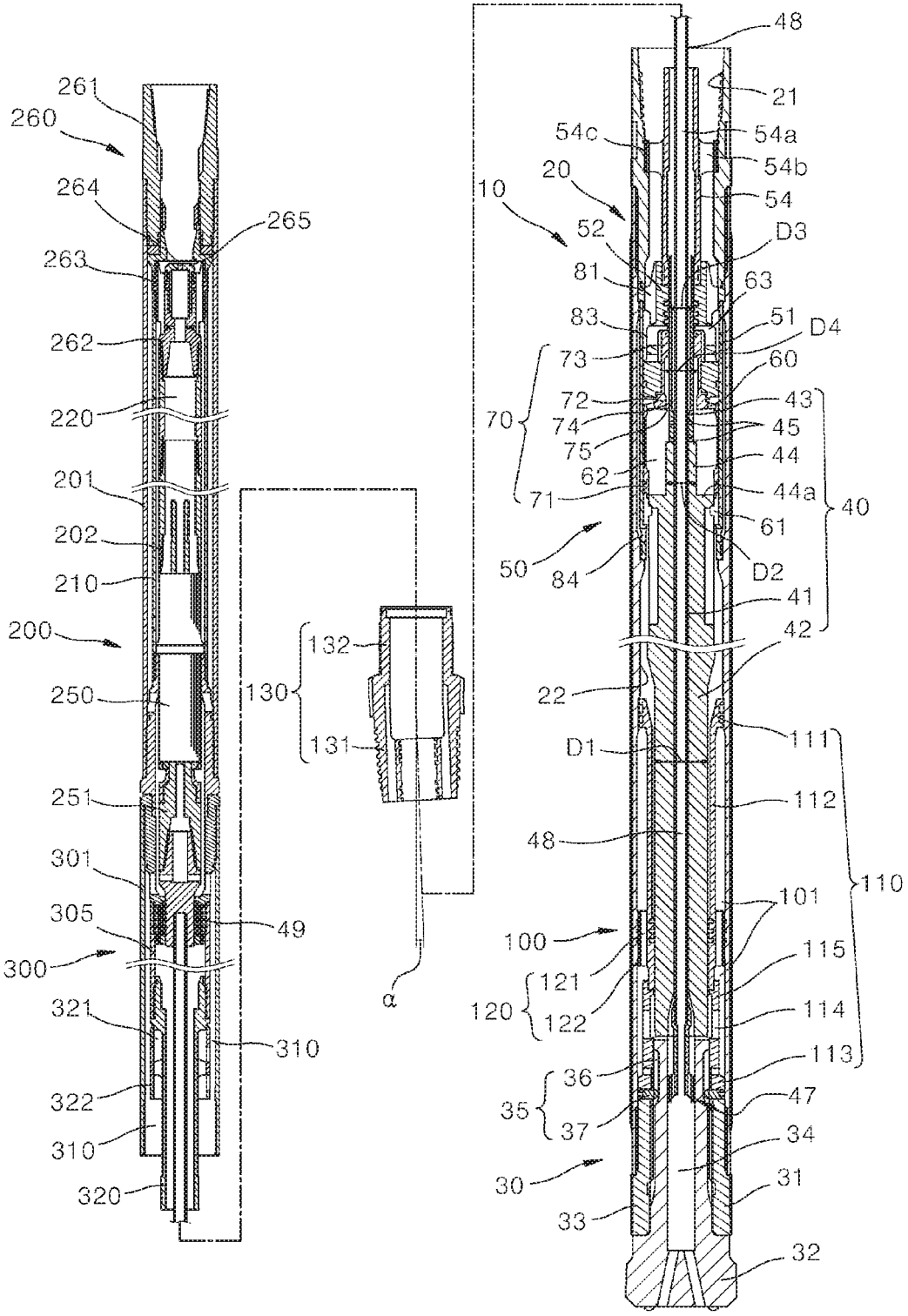
FIG. 2 is an exploded cross-sectional view illustrating the directional drilling apparatus using a water hammer unit according to the present invention.
Figure 3:
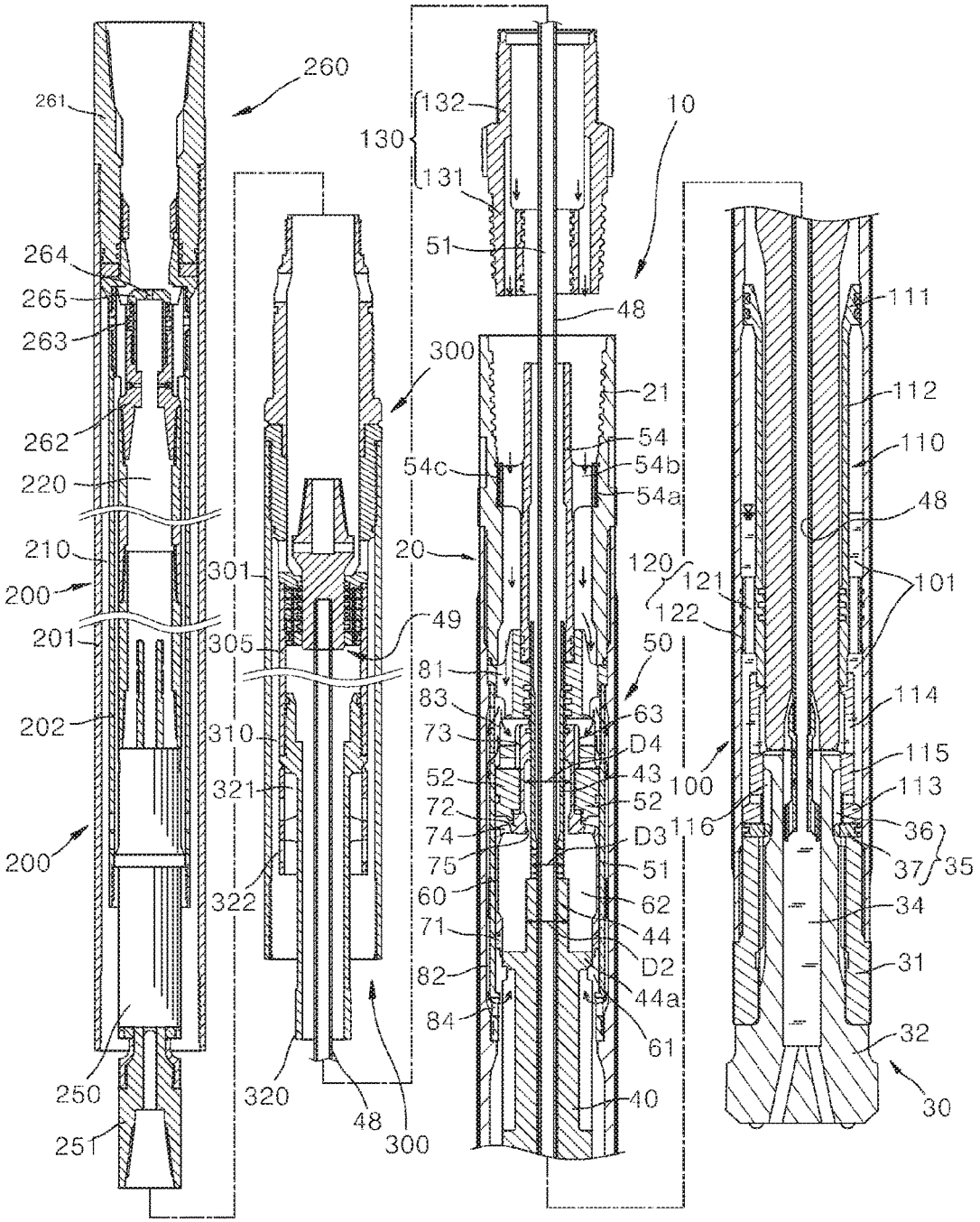
FIG. 3 is a cross-sectional view illustrating the directional drilling apparatus using a water hammer unit according to the present invention.
Figure 7:
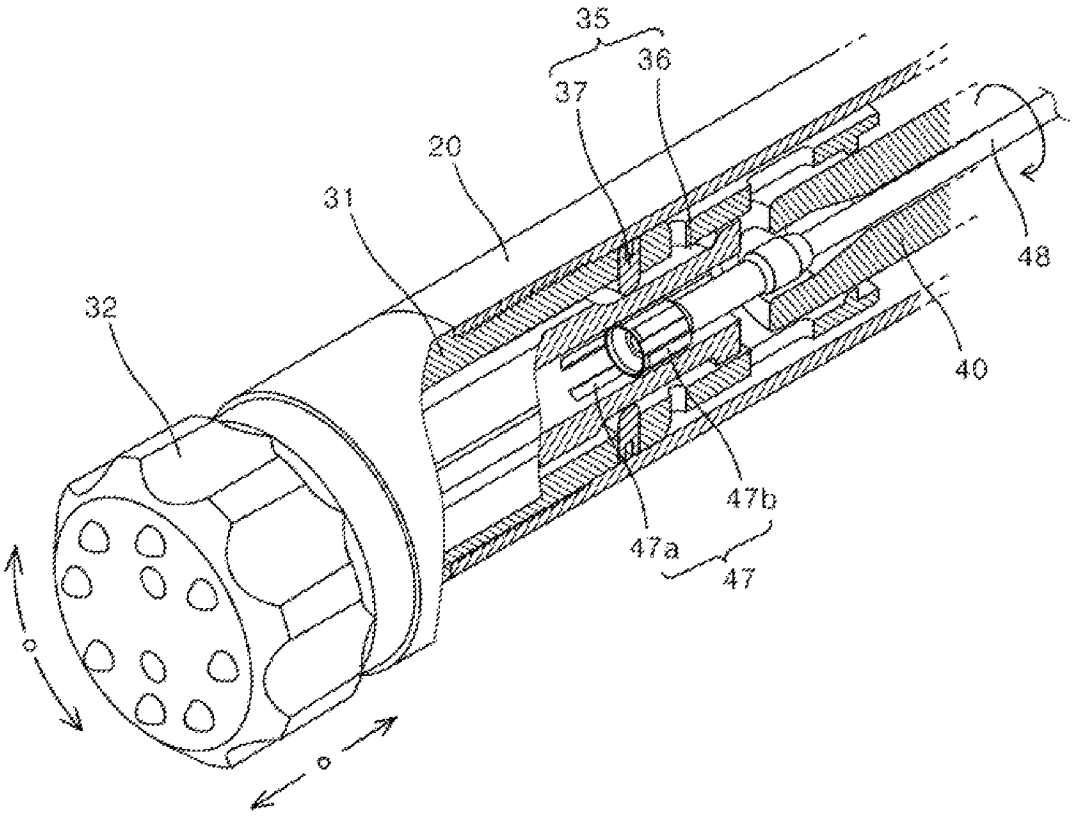
FIG. 7 is a perspective view illustrating a bit portion separated from the directional drilling apparatus using a water hammer unit according to the present invention.

A female spline 47*a* formed on an inner circumferential surface of a hollow portion 34 formed in the bit 32 in a longitudinal direction and a male spline 47*b* formed at an end portion of the rotary shaft 48 may be coupled so that the first coupling part 47 which couples the bit 32 to the rotary shaft 48 may be formed (see FIGS. 2, 3, and 7).

The water hammer unit 10 includes a drive unit 50 installed between an inner circumferential surface of the hammer body 20 and an outer circumferential surface of an upper portion of the piston 40 to support the upper portion of the piston 40 and configured to move the piston 40 upward or downward using water supplied through the mud motor unit 200 or the accumulating unit 300 connected to the hammer body 20. The water hammer unit 10 further includes an operating fluid evacuating portion 100 which is installed between an inner surface of the hammer body 20 between the bit unit 30 installed at a lower end portion of the hammer body 20 and the drive unit 50 and an outer surface of the piston 40 to guide the piston 40, forms an evacuating space for water between the piston 40 and the bit when the piston 40 hits the bit using bit unit 30, separates bubbles from the water introduced into the evacuating space and stores the bubbles therein. In the present invention, the operating fluid evacuating portion 100 does not necessarily need to be installed.

In addition, an operating fluid supplied through the rod connected to the water hammer unit 10 may include a plurality of bubbles. That is, the operating fluid may include the bubbles because bubbles (air) permeate water due to a pump and the water is pumped at high pressure using the pump.

The hammer body 20 of the water hammer unit 10 has a pipe form having a hollow portion 22 therein, and a coupling part 21 for being coupled to the rod is formed at an upper end side of the hammer body 20. A screw may be formed on an inner circumferential surface of an end side of the hammer body 20 to form the coupling part 21.

In addition, the piston 40 is installed in the hollow portion 22 of the hammer body 20 to be movable upward and downward, and the piston 40 is supported by a sub-housing 110 forming the operating fluid evacuating portion 100, the inner circumferential surface of the hammer body 20, and the drive unit 50 installed at an upper side of the piston 40 as described above. In addition, the piston 40 includes an operating fluid discharge path 41 passing through the piston 40 in the longitudinal direction as described above. The rotary shaft 48 passes through the operating fluid discharge path 41.

In the bit unit 30 installed at a lower side of the water hammer body 20, a collar member 31 is installed at the end portion of the hammer body 20, the bit 32 including a hitting part 32 is rotatably installed in the collar member 31 to be movable upward and downward. In addition, in the bit 32 and the collar member 31, a stroke distance restriction unit 35 configured to restrict a stroke distance according to upward or downward movement of the bit 32 is provided. In the stroke distance restriction unit 35, bit guide grooves 36 having a predetermined length (corresponding to the stroke distance of the bit) are formed in an outer circumferential surface of the bit 32 in the longitudinal direction, and a bit locker 37 in which an inner end portion is coupled to the bit guide groove 36 is installed on the collar member 31. The bit locker 37 guides the bit 32 along the bit guide groove 36 to restrict the stroke distance according to upward or downward movement of the bit 32 when the bit 32 moves upward or downward. A discharge path 34 communicating with the operating fluid discharge part 41 of the piston 40 is formed at a central portion of the bit 32.

The drive unit 50 moves the piston 40 upward and downward using water serving as an operating fluid supplied through the rod, a piston housing 51 having a cylindrical form and coupled to the hollow portion 22 of the hammer body 20 is installed in the drive unit 50, and the piston 40 is slidably installed in the piston housing 51 to hit the bit 32.

The piston 40 includes a guide part 42 which guides the piston 40 to slide in the sub-housing 110, and a pressing part 44 and a step portion 43 which are gradually stepped from the guide part 42 and define a valve installation space in which a valve member 70, which will be described below, is installed between an inner circumferential surface of the piston housing 51 and the piston 40, wherein a guide disc 44*a* configured to come into contact with a first stopper 71 of the valve member 70, which will be described below, is formed on the pressing part 44. In addition, a first communication hole 45 communicating with the operating fluid discharge part 41 is formed in the step portion 43 of the piston 40. Here, a diameter D1 of the guide part 42 of the piston 40 is greater than a diameter D2 of the pressing part 44, and a diameter D3 of the step portion 43 of a portion in which the first communication hole 45 is formed is less than the diameter D2.

A sleeve member 52 inserted into and supported by the hammer body 20 and including an accommodation part 53 into which the step portion 43 is inserted and guided is installed at an upper side of the piston housing 51.

In an upper end portion of the hammer body 20, the sleeve member 52 is coupled to a first connecting pipe 54 including a hollow 54*a* communicating with the operating fluid discharge part 41, and a flange 54*c* in which a plurality of first through holes 54*b*, through which a plurality of operating fluids flow, are formed is formed between an outer circumferential surface of the first connecting pipe 54 and the inner circumferential surface of the hammer body 20.

Meanwhile, a valve installation space 60 defined by the piston 40 is formed inside the piston housing 51 and the sleeve member 52. The piston housing 51, the piston 40, and a valve member 70, which is installed to be slidable due to the sleeve member 52, defines the valve installation space 60 into first, second, and third spaces 61, 62, and 63 (see FIGS. 2 and 3), and moves the piston 40 upward or downward using water pressure supplied to a side of the space, are installed in the valve installation space 60.

As illustrated in FIGS. 1 and 2 to 4, the valve member 70 includes a first stopper 71 which is installed between an outer circumferential surface of the pressing part 44 and an inner circumferential surface of the piston housing 51 to have a predetermined width and defines the first space 61, an extension 72 which extends from the first stopper 71 and forms the second space 62 connected to the first communication hole 45, and a second stopper 73 which extends from an end portion of the extension 72, slides to an end side of the piston 40, and defines the third space 63 with the piston 40 and an inner circumferential surface of the sleeve member 52. A through portion 74 which is formed from the second space 62 toward the sleeve member 52 and decreases a relative cross-sectional area on which water pressure is applied is formed at a side of the extension 72 of the valve member 70. In addition, an insertion portion 75 having a diameter substantially the same as the diameter D2 of the pressing part 44 of the piston 40 is formed at the extension 72 of the valve member 70. Since an inner surface of the extension 72 at an upper side of the insertion portion 75 is formed to have a diameter D4 greater than the diameter of the pressing part 44, a difference between a cross-sectional area of the first stopper 71 and a cross-sectional area of the second stopper 72 exposed to the third space 63 may occur.

Here, a cross-sectional area of the piston 40 formed by the guide disc 44*a* formed at the pressing part 44 of the piston 40 and the first stopper 71 in a direction perpendicular to the longitudinal direction of the piston 40 is greater than a cross-sectional area of the step portion 43 exposed to the third space defined by an outer circumferential surface of the step portion 43 of the piston 40, the sleeve member 52, and the second stopper 73 of the valve member 70. In addition, the first stopper 71 which comes into contact with the guide disc 44*a* has a length such that the first stopper 71 is not separated from the guide disc 44*a* even when the valve member 70 moves upward and the first stopper 71 is separated from the guide disc 44*a* to discharge water, which is supplied to the first space 61 so as to move the piston 40 upward, through the second space 62, the first communication hole 45, and the operating fluid discharge part 41 of the piston 40 when the piston 40 moves upward.

Here, at a time point at which the piston 40 initially moves upward, that is, the first stopper 71 and the guide disc 44*a* of the pressing part 44 are separated, the first communication hole 45 and the second space 62 are connected, and the piston 40 moves further upward, a portion, which has the diameter D2, of the pressing part 44 of the piston 40 is coupled to the insertion portion 75, and thus the first communication hole 45 is disconnected from the second space 62.

In addition, an operating fluid supply 80 configured to supply water serving as an operating fluid having a predetermined pressure is provided in the first space 61 and the third space 63 to move the valve member 70 and the piston 40 upward.

In addition, in the operating fluid supply 80, a first water pressure path 81 is formed between the sleeve member 52 and an outer circumferential surface of the hammer body 20, and a second water pressure path 82 communicates with the first water pressure path 81 and is formed between the inner circumferential surface of the hammer body 20 and the outer circumferential surface of the piston housing 51. In addition, a second communication hole 83 is formed in the sleeve member 52 to communicate with the first water pressure path 81 and the third space 63, and a third communication hole 84 communicating with the second water pressure path 82 for supplying an operating fluid to the first space 61 is formed in the piston housing 51. The above-described drive unit of the water hammer apparatus is disclosed in Korea Patent Registration No. 0562954 which is invented and registered by the present inventor.

The operating fluid evacuating portion 100 of the water hammer unit 10 has a structure in which water serving as an operating fluid between the bit 32 and an end portion of the piston 40 is evacuated when the piston 40 hits the bit 32, and the operating fluid is supplied between the bit 32 and the end portion of the piston 40 when the piston moves upward.

The operating fluid evacuating portion 100 includes the sub-housing 110, which is installed at the inner surface of the hammer body 20 and supports a lower portion of the piston 40 and an upper portion of the bit 32, and forms an evacuating space 101 which is formed between the inner circumferential surface of the hammer body and the sub-housing 110 and to which water serving as an operating fluid between the piston 40 and the bit 32 is evacuated when the piston hits the bit 32, and an air-water separating part 120 which is disposed between the sub-housing 110 adjacent to the piston 40 and the bit 32 and the inner circumferential surface of the hammer body 20, and separates bubbles from the water, which has been evacuated when the piston 40 hits the bit 32, to store in an upper portion of the evacuating space.

The sub-housing 110 includes a fixed portion 111 at which an upper end portion thereof is fixedly in contact with the inner circumferential surface of the hammer body 20 and an upper end side of the evacuating space 101 is blocked by the sub-housing and the hammer body 20, a piston guide part 112 which extends downward from the fixed portion 111 to guide the lower portion of the piston 40 and forms the evacuating space 101 between the inner circumferential surface of the hammer body 20 and the piston guide part 112, and a stopper 113 which extends from the piston guide part 112 to guide the outer circumferential surface of the bit 32 and blocks between the outer circumferential surface of the bit 32 and the inner circumferential surface of the hammer body 20 to seal and define a lower side of the evacuating space 101.

In addition, the sub-housing 110 includes a bit guide part 115 in which an operating fluid evacuating hole 114 through which an operating fluid between the piston 40 and the bit 32 is introduced into or discharged from the evacuating space 101 when the piston 40 moves upward or downward for hitting the bit 32. Here, the stopper 113 and the bit guide part 115, in which the operating fluid evacuating hole 114 is formed, may be formed of different materials and coupled to the sub-housing 110. In addition, an operating fluid moving space 116 communicating with the operating fluid evacuating hole 114 may be formed on an inner side of the bit guide part 115 around the bit 32 and the end portion of the piston 40.

In addition, the air-water separating part 120 configured to separate bubbles from water serving as an operating fluid introduced into the evacuating space 101 through the operating fluid evacuating hole 114 to store the water at an upper side of the evacuating space 101 when the piston 40 moves upward or downward includes a defining member 122 which is installed between an outer circumferential surface of the piston guide part 112 adjacent to the bit guide part 115 and the inner circumferential surface of the hammer body 20 and in which a plurality of gas passing holes 121 are formed. The air-water separating part 120 may be formed at a side of the fixed portion 111 adjacent to the bit guide part 115 in which the operating fluid evacuating hole 114 is formed.

In addition, the coupling part 21 of the water hammer unit 10 is coupled to the drilling angle adjusting unit 130 by the accumulating unit 300. In addition, the accumulating unit 300 is coupled to a mud hammer unit.

The drilling angle adjusting unit 130 includes a coupling member 135 having a first drilling angle coupling part 131 coupled to a coupling part of the hammer unit 10, and a second drilling angle coupling part 132 coupled to the accumulating unit 300.

The first drilling angle coupling part 131 and the second drilling angle coupling part 132 are inclined at an angle in the range of 1° to 1.5° for directional drilling (see FIGS. 2 and 3). An inclination angle of the hammer unit 10 coupled to the first drilling angle coupling part 131 is in the range of 1° to 1.5° with respect to the mud motor unit 200 coupled to the second drilling angle coupling part 132 and the accumulating unit 300.

In addition, in the accumulating unit 300, a first outer pipe member 301 and a first inner pipe member 305 are coupled, and a lower end portion of the first outer pipe member 301 is coupled to the second drilling angle coupling part 132 of the drilling angle adjusting unit 130 and thus a third operating fluid supply path 310 is formed. The first inner pipe member 301 is coupled to a first core pipe member 320 through which the rotary shaft 48 passes and thus an air storing tank 321 is formed between an inner circumferential surface of the first inner pipe member 301 and an outer circumferential surface of the first core pipe member 320. In addition, a connecting hole 322, through which the third operating fluid supply path 310 communicates with the air storing tank 321 such that water flows through the third operating fluid supply path 310, is formed at a lower end side of the first inner pipe member 301, and thus an operating fluid is supplied to the water hammer unit through the air storing tank 321. Accordingly, bubbles included in the operating fluid are moved upward and stored in the air storing tank 321.

In addition, the mud motor unit 200 coupled to the accumulating unit 300 by the drilling direction angle adjusting unit 130 includes a second outer pipe body 201, a second inner pipe body 202 which is installed in the second outer pipe body 201, forms a first operating fluid supply path 210 through which, with an inner circumferential surface of the second outer pipe body 201, water is supplied to the water hammer unit 10, and includes a second operating fluid supply path 220, a mud motor 250 which is installed at a lower end side of the second inner pipe body 202 and includes a driving shaft 251 connected to the rotary shaft 48 to rotate the rotary shaft 48, and a pressure distribution unit 260 installed at the second outer pipe body 201 and an end portion of the other side of the second inner pipe body 202 and configured to distribute pressure to the first operating fluid supply path 210 and the second operating fluid supply path 220.

The pressure distribution unit 260 includes a socket 261 installed at the end portion of the exterior to be coupled to the rod, an orifice main body member 262 which has a hollow portion coupled to an end portion of the second inner pipe body 202, having an end portion connected to an inner circumferential surface of the socket 261, and communicating with the second operating fluid supply path 220 and in which a plurality of air passing holes 263 through which the hollow portion communicates with the first operating fluid supply path 210 are formed, and an orifice member 265 which is inserted into the hollow portion of the orifice main body member 262 and in which an orifice hole 264 configured to control a flow rate of an operating fluid passing through the air passing holes 263 and the hollow portion and configured to distribute pressure is formed.

Operation according to boring of the boring apparatus according to the present invention formed as described above will be described with reference to FIGS. 5 and 6.

First, drive rods (not shown) connected to each other of the boring apparatus 1, the mud motor unit 200, and the drilling angle adjusting unit 130 are coupled to perform directional boring work. According to the above coupling, the water hammer unit 10 is coupled at an inclination angle in the range of 1° to 1.5° with respect to the mud motor unit 200.

In a state in which the coupling is completed, an operating fluid having a high pressure supplied by the rod is supplied. Then, the operating fluid is distributed and introduced through the air passing hole 263 of the pressure distribution unit 260 and the orifice hole 264 of the orifice member 265 as illustrated in FIGS. 2 and 3. The pressure distribution may relatively decrease pressure of the operating fluid supplied to the mud motor 250 by considering a flow rate supplied to the mud motor 250 through the orifice hole 264.

Accordingly, the operating fluid supplied through the orifice hole 264 operates the mud motor 250, and since the driving shaft 251 of the mud motor 250 is connected to the rotary shaft 48, the rotary shaft 48 is rotated, and thus the bit is rotated.

In addition, the operating fluid passing through the mud motor 250 is mixed with water passed through the first operating fluid supply path 210, passes through the accumulating unit 300, and is introduced into the first water pressure path 81 and the second water pressure path 82 of the operating fluid supply 80 of the water hammer unit 10.

The operating fluid introduced as described above is supplied to the first space 61 and the third space 63 through the second communication hole 83 formed in the sleeve member 52 and the third communication hole 84 formed in the piston housing 51.

Accordingly, since the cross-sectional area, to which a pressure of is applied, of the first stopper 71 in the longitudinal direction, of the piston 40 is greater than the cross-sectional area to which pressure is applied, of the second stopper 73, a pressure difference occurs between the first and second stoppers 71 and 73 of the valve member 70 due to a difference between the cross-sectional areas. The valve member 70 moves upward due to the pressure difference. At this moment, since the first stopper 71 does not leave the guide disc 44*a* of the pressing part 44 of the piston 40, the pressure applied to the first space 61 does not leak.

In addition, the piston 40 moves upward due to pressure, which is applied to the pressing part 44 of the piston 40, that is, pressure applied to a lower surface of the guide disc 44*a*, of the pressure applied to the first space 61.

As illustrated in FIG. 3, when the piston 40 moves upward to a predetermined height, an outer circumferential surface of the guide disc 44*a* of the pressing part 44 is separated from the first stopper 71, some water, which provides pressure to the first space 61, in the second space 62 is discharged to the operating fluid discharge part 41 through a gap formed between the pressing part 44, the guide disc 44*a*, and the first stopper 71, the second space 62, and the first communication hole 45 formed in the piston 40.

Figure 4:
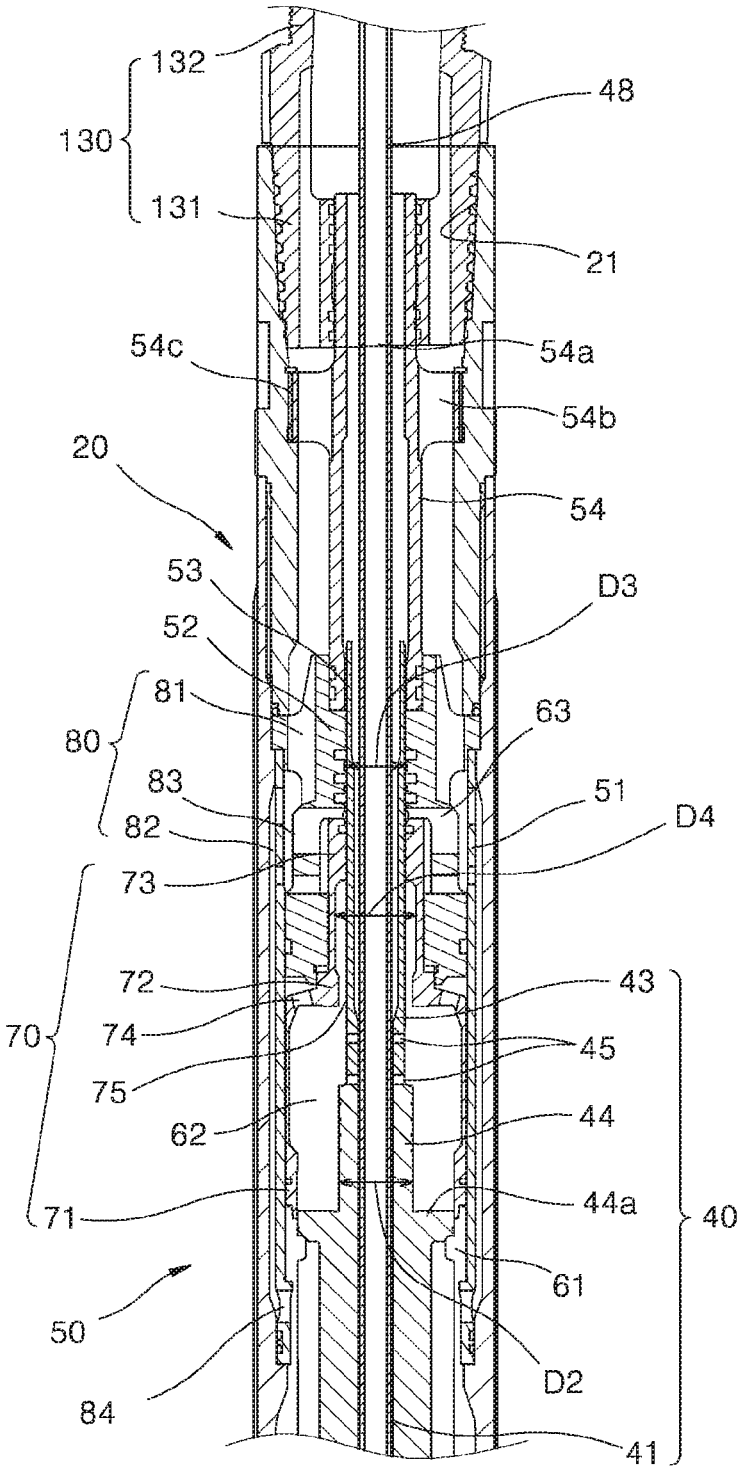
FIG. 4 is an enlarged cross-sectional view illustrating a drive unit of the directional drilling apparatus using a water hammer unit according to the present invention.
Figure 5:
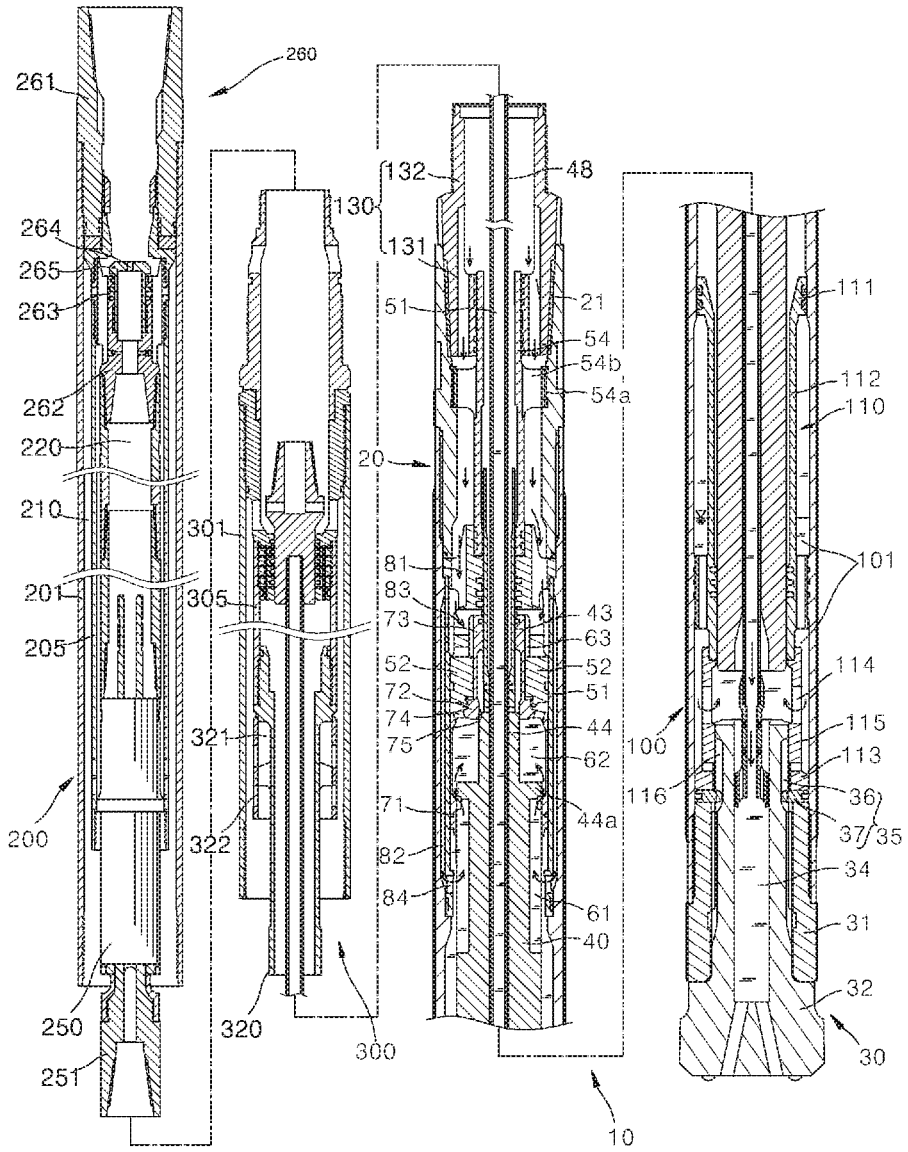
FIGS. 5 and 6 are cross-sectional views illustrating an operating state of the directional drilling apparatus using a water hammer unit according to the present invention.
Figure 6:
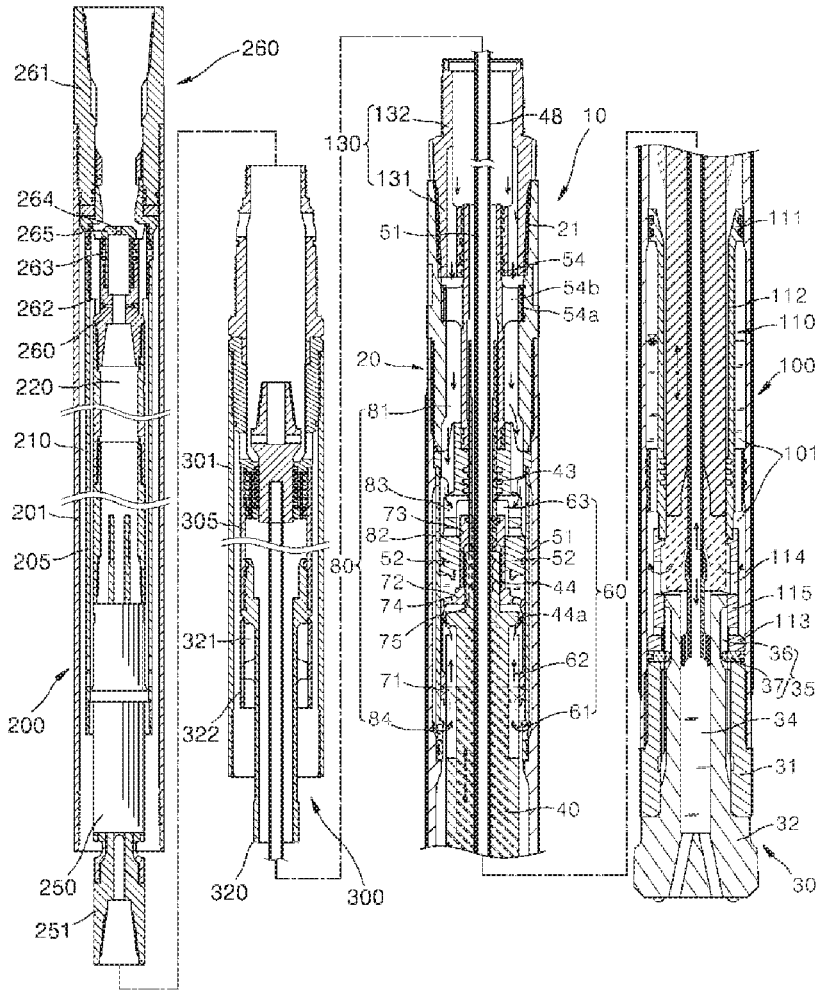

In addition, when the piston 40 is moved upward further, the first communication hole 45 formed in the step portion 43 is blocked because an end side of the pressing part 44 having the diameter D2 is coupled to the insertion portion 75 of the valve member 70 supported by the slide member 52 and the piston housing 51 (see FIGS. 3 and 4).

Accordingly, since pressures in the first and third spaces 61 are 63 are the same and a pressure difference occurs between pressure applied to the cross-sectional area of the second stopper 73 of the valve member 70 exposed to the third space and pressure applied to the first stopper 71, the valve member 70 is moved downward. That is, since the cross-sectional area of the second stopper 73 exposed to the third space 63 is relatively greater than the cross-sectional area of the first stopper 71 exposed to the second space 62, the valve member 70 is moved downward.

Accordingly, one sealed space is formed in which the first and the second spaces 61 and 62 communicate with each other. In this state, since a cross-sectional area of a stopper 44 including the guide disc 44*a* is greater than cross-sectional area of the step portion 43 exposed to the third space and pressure applied to the pressing part 32*c* is relatively high, the piston 40 is moved downward to the guide disc 44*a* of the stopper 44 and hits the bit 32 rotated by the rotary shaft 48.

Meanwhile, a hole bored by the hammer apparatus and the operating fluid discharge part 41 are filled with water serving as an operating fluid during the process operated as described above, and since the operating fluid evacuating portion 100 is formed in the hammer apparatus, reduction of hitting power and ascending power, which may occur because the water positioned between the piston 40 and the bit 32 interferes with the piston 40, may be prevented.

More specifically, when the drive unit 50 operates to move the piston 40 downward so as to hit the rotating bit 32, water serving as an operating fluid between the end portion of the piston 40 and the bit 32 is introduced into the evacuating space 101 through the operating fluid evacuating hole 114 to reduce resistance against downward movement of the piston 40.

Since bubbles are included in the water which serves as the operating fluid and is evacuated to the evacuating space 101, the bubbles are moved upward through the gas passing hole 121 formed in the defining member 122 which defines the evacuating space 101, stored at the upper side of the evacuating space 101, and compressed therein. In addition, when the piston 40 hits the bit 32 and moves upward, as illustrated in FIG. 4, the compressed air stored at the upper side of the evacuating space 101 and the operating fluid positioned at a lower side of the evacuating space 101 are introduced and supplied between the piston 40 and the bit 32 through the operating fluid evacuating hole 114 positioned under the evacuating space 101, and the introduced water acts as pressure for moving the piston 40 upward, and thus the piston 40 is easily moved upward.

Particularly, as a boring depth in the ground is increased, drive rods should be continuously connected, and in this case, air in an empty space of the drive rod permeates water when the water is introduced, moves with water, is separated from the water, and thus bubbles supplied to the evacuating space move upward. In order to increase pressure of the air stored in the evacuating space, the air also permeates an operating fluid for operating the water hammer apparatus and may be pumped with high pressure as described above.

As described above, while drilling work is performed by the directional drilling apparatus using a water hammer unit according to the present invention, the water hammer unit is installed in the mud motor unit 200 to be inclined at a predetermined angle (ranging from 1° to 1.5°) due to the drilling angle adjusting unit 130, directional drilling can be performed. That is, since the bit is rotated by the mud motor unit 200 and the water hammer unit 10 is obliquely installed due to the mud motor unit 200, directional drilling is performed with respect to a straight direction according to drilling.

The present invention has been described with reference to the embodiments illustrated in the drawings, but is only an example, and variously modified and equivalent embodiments may be made therefrom by those skilled in the art.

Accordingly, the scope of the present invention will be defined by only the appended claims.

The invention claimed is:

1. A directional drilling apparatus comprising:

a water hammer unit including a hammer body in which a bit unit configured to perform boring work is installed to be movable upward and downward at an end portion of the hammer body; a piston slidably installed on the hammer body and including an operating fluid discharge part formed in a longitudinal direction; a drive unit installed between the hammer body and the piston to support an upper portion of the piston and configured to move the piston upward and downward using water supplied through a rod connected to the hammer body; and a bit unit having a rotary shaft which passes through the piston and is coupled to a bit by a first coupling part and so as to transmit a rotational force in a state in which the bit is moved upward or downward, a mud motor unit including an outer pipe body coupled to the hammer body by a drilling direction angle adjusting unit; an inner pipe body installed inside the outer pipe body to form a first operating fluid supply path through which an operating fluid is supplied to an inner circumferential surface of the outer pipe body and the water hammer unit and including a second operating fluid supply path; a mud motor installed at a lower end side of the inner pipe body and including a driving shaft connected to the rotary shaft so as to rotate the rotary shaft; and a pressure distribution unit installed on the other side of the outer pipe body and the inner pipe body so as to distribute pressure to the first operating fluid supply path and the second operating fluid supply path, and an operating fluid evacuating portion including a sub-housing which is installed between the hammer body and the piston, which is disposed between the bit unit and the drive unit, to guide the piston, forms an evacuating space to which the water between the piston and the bit is evacuated when the piston hits the bit; and an air-water separating part formed between the sub-housing adjacent to the piston and a hitting part of the bit and the hammer body and configured to separate the bubbles from the water evacuated when the piston hits the bit and to store the water at an upper portion of the evacuating space, wherein the sub-housing includes:

a fixed portion of which an upper end portion is fixedly in contact with the inner circumferential surface of the hammer body;

a piston guide part which extends downward from the fixed portion to guide the lower portion of the piston and forms the evacuating space between the inner circumferential surface of the hammer body and the piston guide part;

a bit guide part which extends from the piston guide part and in which operating fluid evacuating holes, through which the operating fluid between the piston and the bit is introduced into or discharged from the evacuating space when the piston moves upward or downward to hit the bit, are formed; and a stopper which extends from the bit guide part to guide the outer circumferential surface of the bit and blocks between the inner circumferential surface of the hammer body and the outer circumferential surface of the bit, wherein an operating fluid moving space communicating with the operating fluid evacuating hole is formed in an inner surface of the bit guide part around the bit and an end portion of the piston.

2. The directional drilling apparatus of claim 1, wherein the air-water separating part includes a defining member which is installed between an outer circumferential surface of the piston guide part adjacent to the bit guide part and the inner circumferential surface of the hammer body and in which a plurality of gas passing holes are formed.

3. The directional drilling apparatus of claim 1, wherein, the first coupling part which connects the bit and the rotary shaft includes a female spline and a male spline formed in an inner circumferential surface of a longitudinal hollow portion of the bit and an end portion of the rotary shaft, respectively, to be coupled to each other.

4. The directional drilling apparatus of claim 1, wherein the pressure distribution unit includes:

a socket installed at an end portion of the exterior to be coupled to the rod;

an orifice main body member which has a hollow portion coupled to an end portion of the inner pipe body, having an end portion coupled to an inner circumferential surface of the socket, and communicating with the second operating fluid supply path and in which a plurality of air passing holes communicating with the hollow portion and the first operating fluid supply path are formed; and an orifice member inserted into the hollow portion of the orifice main body member to control a flow rate of the operating fluid passing through the air passing holes and the hollow portion so as to distribute pressure.

* * * * *